US011603610B2

(12) United States Patent
Varghese et al.

(10) Patent No.: US 11,603,610 B2
(45) Date of Patent: Mar. 14, 2023

(54) NOISE CONTROL ARTICLE

(71) Applicant: 3M INNOVATIVE PROPERTIES COMPANY, St. Paul, MN (US)

(72) Inventors: Alex Varghese, Bangalore (IN); Deval Yogendra SurendraKumar Vashistha, Bangalore (IN); Dhritisunder Bhattacharya, Bangalore (IN); Satish Palled, Bangalore (IN)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 498 days.

(21) Appl. No.: 16/629,407

(22) PCT Filed: Jul. 10, 2018

(86) PCT No.: PCT/IB2018/055082
§ 371 (c)(1),
(2) Date: Jan. 8, 2020

(87) PCT Pub. No.: WO2019/012426
PCT Pub. Date: Jan. 17, 2019

(65) Prior Publication Data

US 2020/0173072 A1 Jun. 4, 2020

(30) Foreign Application Priority Data

Jul. 14, 2017 (IN) ..... 201741025000
Nov. 28, 2017 (IN) ..... 201741025000

(51) Int. Cl.
*D04H 1/435* (2012.01)
*D06M 15/233* (2006.01)
(Continued)

(52) U.S. Cl.
CPC ..... *D04H 1/435* (2013.01); *D06M 11/76* (2013.01); *D06M 11/79* (2013.01);
(Continued)

(58) Field of Classification Search
CPC ..... D10B 2505/12; D06N 2209/02; D06N 2209/025; G10K 11/16; G10K 11/165;
(Continued)

(56) References Cited

U.S. PATENT DOCUMENTS 3,581,322 A 6/1971 Marsico
4,112,175 A * 9/1978 Kikuchi ..... E04B 1/8409 442/228
(Continued)

FOREIGN PATENT DOCUMENTS

EP 2628837 8/2013
EP 2926966 10/2015
(Continued)

OTHER PUBLICATIONS

International Search Report for PCT International Application No. PCT/IB2018/055082, dated Oct. 5, 2018, 5pgs.

*Primary Examiner* — Jeremy R Pierce
*Assistant Examiner* — Christine X Nisula
(74) *Attorney, Agent, or Firm* — 3M Innovative Properties Company

(57) ABSTRACT

A conformable noise control article useful reducing noise in a motor vehicle is provided. The article includes a nonwoven fiber web that is impregnated with a polymeric matrix composition having low (Tg) and high (Tg) polymers, additives and inorganic fillers. The density of the noise control article is at least ten times more than the density of the nonwoven fiber web. The article has an air flow resistivity that is at least ninety times greater than the air flow resistivity of a bare nonwoven web and exhibits a sound transmission loss in the frequency spectrum of 125 Hz to 5000 Hz.

16 Claims, 8 Drawing Sheets

(51) Int. Cl.

| | |
|---|---|
| ***D06M 15/263*** | (2006.01) |
| ***D06M 101/32*** | (2006.01) |
| ***D06M 11/76*** | (2006.01) |
| ***D06M 11/79*** | (2006.01) |
| ***D06M 15/53*** | (2006.01) |

(52) U.S. Cl.
CPC ..... *D06M 15/233* (2013.01); *D06M 15/263* (2013.01); *D06M 15/53* (2013.01); *D06M 2101/32* (2013.01); *D10B 2505/12* (2013.01)

(58) Field of Classification Search
CPC . B32B 2307/10; B32B 2307/102; E04B 1/74; E04B 1/84; B60R 13/08; B60R 13/0815; B60R 13/083; B60R 13/0838; B29K 2995/0001; B29K 2995/0002; Y10T 442/25
See application file for complete search history.

(56) References Cited

U.S. PATENT DOCUMENTS

| | | | |
|---|---|---|---|
| 5,022,943 | A | 6/1991 | Zaima |
| 5,298,694 | A | 3/1994 | Thompson et al. |
| 5,741,824 | A | 4/1998 | Butschbacher et al. |
| 6,133,172 | A | 10/2000 | Sevenish et al. |
| 6,773,756 | B2 | 8/2004 | Meyer-Ahrens et al. |
| 6,774,068 | B2 | 8/2004 | Park |
| 6,983,822 | B2 | 1/2006 | O'Regan et al. |
| 7,249,654 | B2 | 7/2007 | Nakamoto et al. |
| 8,153,245 | B2 | 4/2012 | Naji et al. |
| 2004/0211934 | A1* | 10/2004 | LeStarge ..... G10K 11/165 252/62 |
| 2006/0137799 | A1 | 6/2006 | Haque et al. |
| 2014/0272318 | A1 | 9/2014 | Lawrence et al. |
| 2014/0287644 | A1 | 9/2014 | Lee |
| 2015/0259904 | A1 | 9/2015 | Kim et al. |
| 2015/0322622 | A1 | 11/2015 | Gaillard et al. |
| 2016/0311381 | A1* | 10/2016 | Dimmer ..... C08F 220/14 |

FOREIGN PATENT DOCUMENTS

| | | |
|---|---|---|
| GB | 822701 | 10/1959 |
| GB | 1282171 | 7/1972 |
| GB | 1445201 | 8/1976 |
| GB | 2013743 | 8/1979 |
| JP | 2001233249 | 8/2001 |
| JP | 5389384 | 1/2010 |
| WO | WO 97/00346 | 1/1997 |
| WO | WO 2004/088025 | 10/2004 |
| WO | WO 2006/107847 | 10/2006 |
| WO | WO 2015-127496 | 9/2015 |

* cited by examiner

NOISE CONTROL ARTICLE

CROSS REFERENCE TO RELATED APPLICATIONS

This application is a national stage filing under 35 U.S.C. 371 of PCT/IB2018/055082, filed Jul. 10, 2018, which claims the benefit of India Application Nos. 201741025000, filed Jul. 14, 2017 and 201741025000, filed Nov. 28, 2017, the disclosures of which are incorporated by reference in their entireties herein.

TECHNICAL FIELD

Present invention relates to a noise control article, and a method of controlling noise in vehicles (e.g., in motor vehicles).

BACKGROUND OF THE INVENTION

Noise, vibration and harshness (NVH) refers to the perceived level of noise, vibration and harshness inside or outside motor vehicles in use. Drivers and passengers place increasing importance on vehicle comfort, and a key factor influencing their satisfaction with a vehicle is the level of NVH.

There are a number of noise and vibration sources in the typical motor vehicle, such as the engine, the power train, the exhaust system, the suspension, the tires, ventilating and air conditioning system, or other vehicle components that vibrate in use. Vehicle designers use various solutions to manage the perceived NVH level of a vehicle. For example, absorbers, barriers, dampers and/or isolaters are placed at key positions in the vehicle to reduce noise and vibration by absorbing noise, reflecting noise, and dampening or isolating vibration. A typical location for placement of an absorber is along the firewall between the engine compartment and the dashboard in the passenger compartment, this is also sometimes referred to as a "front of dash" application.

SUMMARY OF THE INVENTION

Conventional products used for NVH reduction (e.g., in front of dash applications), like felt fabrics with a reinstated fabric, can have one or a combination or all of the following limitations: (a) poor reduction of low frequency, mid-frequency and high frequency noise, (b) poorer noise reduction properties after extended exposure to heat, (c) inadequate conformability leading to gaps between the NVH product and the vehicle frame through which noise may leak, and (d) high weight, for example conventional products weight about 5,000 to 10,000 grams per square meter, thus adding undesirable weight to the vehicle. So, improved NVH solutions are still needed that provide good noise and vibration reduction and reduced weight, particularly for vehicles with noisy engines, fuel and exhaust systems.

The present invention provides a conformable noise control article for a motor vehicle comprising a nonwoven fiber web impregnated with a polymeric matrix. The matrix comprises a low glass transition temperature (Tg) polymer, high glass transition temperature (Tg) polymer, relative to the overall weight of the nonwoven fiber web, polymeric matrix and one or more additives and inorganic fillers, wherein the density of the noise control article is at least ten times more than the density of the nonwoven fiber web and air flow resistivity of the noise article is greater than the air flow resistivity of the nonwoven fiber web, and the noise article produces a sound transmission loss (STL) in the frequency spectrum of 125 Hz to 5000 Hz.

Present invention provides flexible, lightweight, noise control article that is effective at reducing low, mid and high frequency noise.

In one application, the noise article is suitable for use in high temperature areas like front of dash or firewall applications in motor vehicles.

The article as described in the present invention are capable of being formed (e.g., by molding) into any shape, including complex shapes without a need for pre-heating the noise article before molding.

BRIEF DESCRIPTION OF THE DRAWINGS

The foregoing summary, as well as the following detailed description of the invention will be better understood when read in conjunction with the appended drawings. For the purpose of assisting in the explanation of the invention, there are shown in the drawings embodiments which are presently preferred and considered illustrative. It should be understood, however, that the invention is not limited to the images shown in the drawings.

DETAILED DESCRIPTION OF EMBODIMENTS

Figure 1:
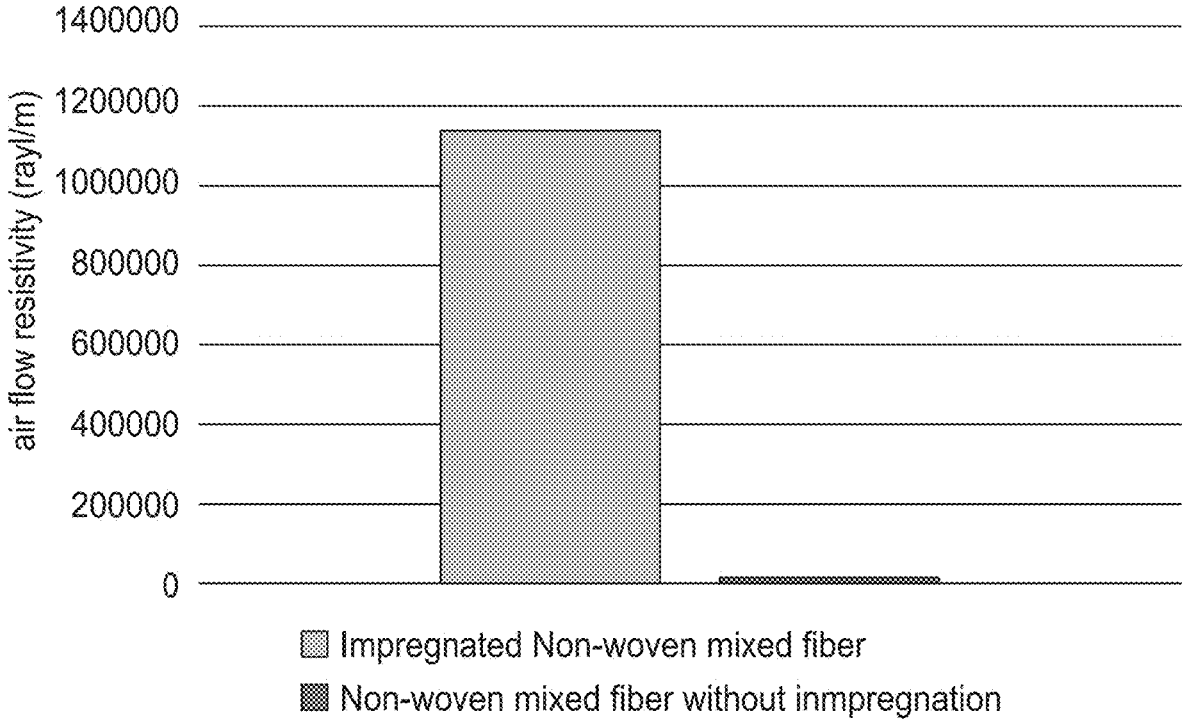
FIG. 1 is a graph compares the air flow resistivity of an exemplary impregnated nonwoven fiber web of the present invention with the airflow resistivity of a nonwoven fiber web without impregnation.

For the purpose of the following detailed description, it is to be understood that the invention may assume various alternative variations and step sequences, except where expressly specified to the contrary. Thus, it is to be understood that this invention is not limited to particularly exemplified systems or embodiments that may, of course, vary. The use of examples anywhere in this specification including examples of any terms discussed herein is illustrative only, and in no way limits the scope and meaning of the invention or of any exemplified terms. Likewise, the invention is not limited to various embodiments given in this specification.

Unless otherwise defined, all technical and scientific terms used herein have the same meaning as commonly understood by one of ordinary skill in the art to which this invention pertains.

As used herein, the singular form "a" "an" and "the" include plural references unless the context clearly dictates otherwise. The term "and/or" mean one or all of the listed elements or a combination of any two or more of the listed elements.

The term "preferred" and "preferably" refer to embodiments of the invention that may afford certain benefits, under certain circumstances. However, other embodiments may also be preferred under the same or other circumstances. Furthermore, the recitation of one or more preferred embodiments does not imply that the other embodiments are not useful, and is not intended to exclude other embodiments from the scope of the invention.

When the term "about" is used in describing a value or an endpoint of a range, the disclosure should be understood to include the specific value or end point referred to.

As used herein the terms "comprises", "comprising", "includes", "including", "containing", "characterized by", "having" or any other variation thereof, are intended to cover a non-exclusive inclusion.

The term "nonwoven fiber web" (NFW) refers to a material comprising recycled or virgin (or both) polyethylene terephthalate (PET) fibers.

The term "polymeric matrix" refers to a composition comprising one or more aqueous polymeric emulsions and optionally, binders, additives, inorganic fillers and colors.

The term "impregnation" refers to diffusing or imbuing a nonwoven fiber web with a substance. The term impregnation and saturation are used interchangeably herein.

The term "incident sound wave" refers to a random sound wave within the audible frequency range emitted from a sound source towards a noise control treating article.

The term "inorganic fillers" as used herein refers to compounds selected from the group consisting of mica, calcium carbonate, silica bubbles (glass bubbles), cenospheres and combinations thereof. These compounds create a matrix with porosity and provide sound transmission loss properties.

The term "anti-foaming agent" as used herein refers to a chemical additive that reduces and hinders the formation of foam. The terms anti-foaming agent and defoamer are often used interchangeably. Commonly used anti-foaming agents are silicon glycol, polypropylene glycol copolymers and combinations thereof. These anti-foaming agents helps in enhanced wetting of fillers and provide proper wetting of PET fibers in the non-woven fiber web during impregnation process.

The term "additives" as used herein refers to compounds that lower the surface tension or interfacial tension between two liquids or between a liquid and a solid. These additives may act as surfactants, detergents, wetting agents, emulsifiers, foaming agents, dispersants, and combinations thereof. These additives help in enhanced wetting of fillers with binder system and also help proper wetting of PET fiber during impregnation process.

The term "binders or binding agents" as used herein refers to any material or substance that holds or draws other materials together to form a cohesive whole mechanically, chemically, by adhesion or cohesion.

The noise control article as described herein provides lightweight, enhanced acoustic properties. The article can be flexible, moldable into a three-dimensional (3D) shape, and malleable to complex shapes without losing its structural and physical integrity when subjected to various hydraulic assisted press molding processes. Further, in some embodiments, the noise article is flame resistant and can be used in many other applications where the noise article is exposed to high temperatures.

The noise control article as described in the present invention can provide better thermal management while maintaining the acoustic performance properties after heat aging.

In an embodiment of the present disclosure, the noise control article comprises (a) nonwoven fiber web (b) impregnated with polymeric matrix comprising one or more medium, binders, additives, fillers and colors. The noise control article can be light weight, thermal resistive and able to absorb random incident low, middle and high frequency sound waves.

In an embodiment of the present disclosure, the nonwoven fiber web is selected from the group consisting of one or more types of recycled PET or virgin PET or both. In an embodiment, the nonwoven fiber web is formed by a random distribution of minute PET fibers in a web form. This web form is self-bonded with no binder being added to maintain the sheet integrity. The texture of the bonded surface is smooth and exhibits good tear resistance as well as low air flow resistivity. In one embodiment, the nonwoven fiber web is a carded, needle punched web. The nonwoven fibers can be bonded together by chemical, mechanical, heat or solvent treatment. These nonwoven fiber web can be made from long and short staple fibers and can be either woven or knitted.

In an embodiment of the present disclosure, basis weight of the nonwoven fiber web may be selected from the range between 100 to 1200 grams per square meter (gsm) preferably between 180 to 600 gsm, most preferably between 300 to 500 gsm. The ranges as described above provides desired polymeric matrix holding capacity and also exhibit higher tear resistance properties.

The nonwoven fiber web is impregnated with a polymeric matrix containing one or more combination of medium, binders, inorganic fillers, additives and colorants. In an embodiment of the present disclosure, the polymeric matrix comprises binders. These binders are selected from the group containing water based high glass transition temperature (Tg) polymers having a glass transition temperature in the range of 10 to 135 degrees Celsius and low glass transition temperature (Tg) polymers having a glass transition temperature in the range of −10 to 50 degrees Celsius. The low (Tg) polymer is selected from aqueous copolymer dispersions of an acrylic acid ester and styrene. The low (Tg) polymer(s) is present in an amount between the range of from 15 to 25% by weight, based on the weight of the polymeric matrix. The high (Tg) polymer is selected from aqueous copolymer of ethyl acrylate and methyl methacrylate. The high (Tg) polymer(s) is present in an amount between the range of from 10 to 15% by weight, based on the weight of the polymeric matrix.

Binders are responsible for holding the fillers together as well as binding the discontinuous fiber matrix of the nonwoven fiber web. Low (Tg) polymers and the high (Tg) polymers can optionally be selected in a ratio of approximately 3:2. The combination of low and high (Tg) polymers enables viscoelastic behavior and is responsible for imparting desired stiffness and moldability of the noise article. The article can be molded into a variety of 3D shapes. Viscoelastic behavior of the binders over a wide thermal regime reduces the resonant frequency of the incident sound waves. Viscoelastic behavior of the polymeric matrix over a wide thermal regime having consistent levels of shear and elastic moduli retains the sound transmission class (STC) build up performance.

Adding inorganic fillers such as glass bubbles can create a matrix with porosity and provide sound transmission loss properties.

In an embodiment of the present disclosure, the colorants are selected, such as carbon black. Colorants are added to improve aesthetics or for identification of materials of different basis weight.

In an embodiment of the present disclosure, the medium includes water and sodium hydroxide. In the present disclosure, water acts as a carrier for the binder and the combination of water and wetting agents, dispersant agents and coloring agents acts as a processing aid. Further, sodium hydroxide stabilizes the pH of the medium, thereby stabilizing the polymeric matrix.

Water may be present in an amount 5 to 30% by weight and preferably around 6% by weight based on the total weight of the polymeric matrix. Sodium hydroxide may be present in an amount 0.5 to 1.0% weight and preferably of 0.7% by weight, based on the total weight of the polymeric matrix.

In an embodiment of the present disclosure, the one or more additives which may be operative herein illustratively includes wetting agents and dispersants. In an embodiment, the composition as per the present disclosure may contain one or more such additives. The wetting agent present in an amount in the range of from 1.0 to 3.0% by weight based on the total weight of the polymeric matric. The dispersants may present in an amount in the range of from 1.0 to 3.0% by weight, based on the total weight of the polymeric matrix.

In an embodiment of the present disclosure, the one or more inorganic fillers which may be operative herein illustratively includes calcium carbonate, silica bubbles (glass bubbles), cenospheres and mica. In an embodiment, the composition as per the present disclosure may contain one or more inorganic fillers. The inorganic fillers present in an amount in the range of from 01 to 50% by weight, based on the total weight of the polymeric matrix.

In an embodiment of the present disclosure, the colors which may be operative herein illustratively includes black pigment. In an embodiment, the composition as per the present disclosure may contain one or more such colors. The color present in an amount in the range of from 1.0 to 3.0% by weight, based on the total weight of the polymeric matrix.

In an embodiment of the present disclosure, the nonwoven fiber web is impregnated with a polymeric matrix on both sides of the fiber web.

The impregnation of the nonwoven fiber web can be performed by dipping, saturation, pressure application or thermal application.

In an embodiment of the present disclosure, the impregnation of the nonwoven fiber web is carried out by a dip coating process wherein the nonwoven fiber web is dipped into a tank containing the polymeric matrix composition. Excess polymeric matrix composition is squeezed out from the nonwoven fiber web by, e.g., passing the impregnated fiber web between two rollers. The pressure exerted onto the fiber by the rollers is adjusted to obtain a final nonwoven article. Polymeric matrix impregnated nonwoven fiber web is further subjected to drying, performed at a temperature in a range of between 80 and 180° C. for a duration of 60 to 180 minutes. Drying is performed to drive away the water contained in the formulation. Water can be used as a medium or processing aid. Process aids may also include wetting agents, dispersing agents, plasticizers and coloring agents. Drying of polymeric matrix impregnated nonwoven fiber web can be carried out by passing it through a static or continuous hot air oven.

Impregnated nonwoven fiber web is light in weight as compared to conventional noise control materials. Lower basis weights nonwoven fiber web provides an impregnated nonwoven fiber web having lower density. Higher basis weight values provide higher density of the impregnated nonwoven fiber web. Density can increase from non-woven fiber web to impregnated nonwoven fiber web (~50 kilograms/cubic meter). For example, if the impregnated nonwoven fiber web material has a basis weight between 1000 and 2000 gsm, the density of the material would be around 76 kilogram/cubic meters. Between 2500 and 3500 gsm, the density of the noise article will be around 106 kilogram/cubic meters. Between 3500 and 4500 gsm, the density will be 130 kilogram/cubic meters. Between 4500 and 5500 gsm, the density will be around 153 kilogram/cubic meters. Between 5500 and 7700 gsm, the density will be around 203 kilogram/cubic meters.

In an embodiment of the present disclosure, the impregnated nonwoven fiber web is tested for sound transmission loss (STL) in order to determine the sound reflection property of the impregnated nonwoven fiber web. Impregnated nonwoven fiber web can show a higher sound transmission loss as compared to the normal nonwoven fiber web, i.e., a bare nonwoven fiber web that has not impregnated. The polymeric matrix creates high impervious structure yielding to high sound transmission loss. Impregnated nonwoven fiber web having higher sound transmission loss over substantially the entire frequency range, from 125 Hz to 5000 Hz.

In an embodiment of the present disclosure, the impregnated nonwoven fiber web is tested for STL after heat aging exposure at 120 degrees Celsius for 500 hrs and 1000 hrs. Impregnated nonwoven fiber web have shown, in some embodiments, high performance of sound transmission loss.

In an embodiment of the present disclosure, the impregnated nonwoven fiber web exhibit improved sound transmission loss properties at resonant frequencies. Resonance is the range of frequencies at which the excitation frequency coincides with the natural vibration frequency of the structure, resulting in higher levels of sound energy emittance from the system. Therefore, the performance of a noise control material will be minimized at resonant frequencies and will have a cascading effect beyond resonant frequencies. The objective of the noise control article is to reduce this effect of lowered performance at resonant frequencies. One way to achieve higher performance is by narrowing down the resonant frequency band so that detrimental impact of the overall excitation energy from the sound source is minimized. In an embodiment of the present disclosure, an impregnated nonwoven fiber web/noise control treating article narrows down the resonance frequency (125 to 160 Hz) band to a significant level as shown in Example 10, TABLE 9.

Figure 8A:
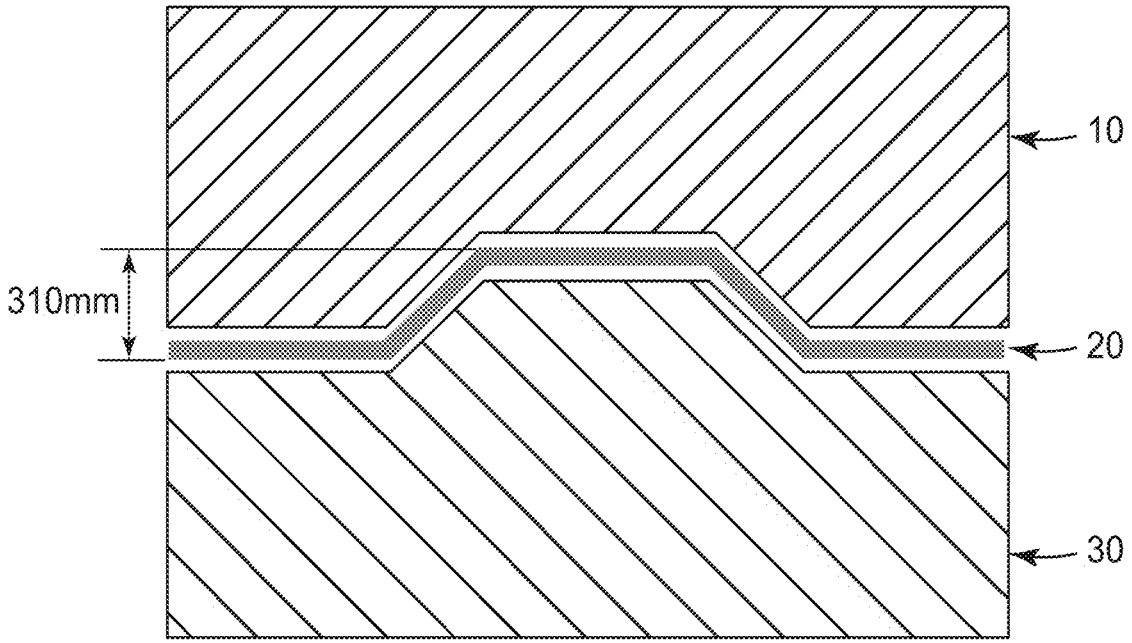
FIGS. 8a and 8b show embodiments of the impregnated nonwoven fiber web molded in various configurations.
Figure 8B:
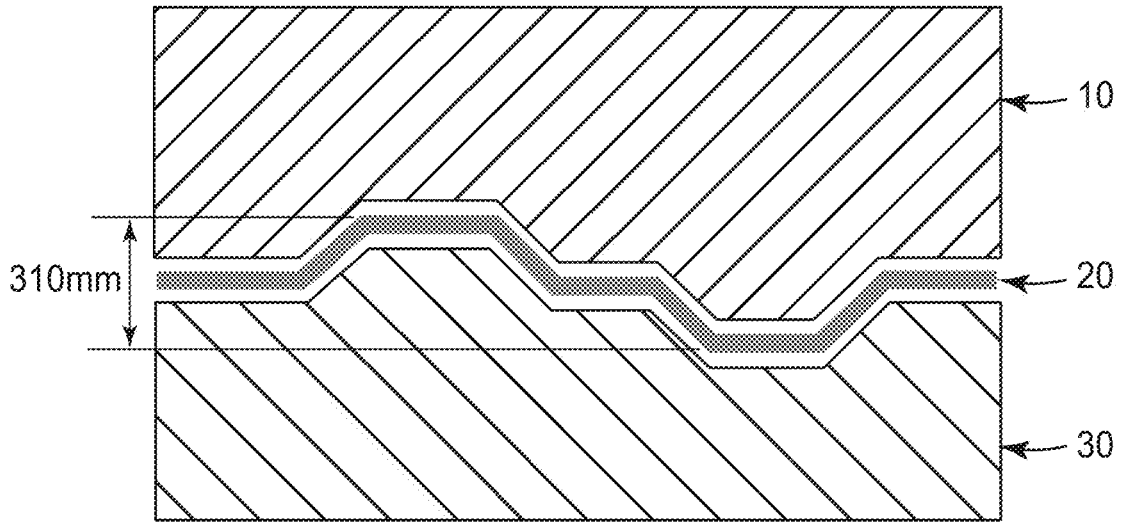

In an embodiment of the present disclosure, the impregnated nonwoven fiber web can be molded to complex shapes. Up to 310 mm of drawability may be used in a compression molding process. As shown in FIGS. 8a and 8b, impregnated nonwoven fiber web (i.e., the noise control articles of the present invention) 20 is shaped between a top mold 10 and a bottom mold 30. FIG. 8b shows that the noise control articles can be molded in complex molds with positive and negative features. Molding can be carried without any pre-heating thereby enabling cost effective and easy handling of large parts. Moldability and drawability can be achieved because of the use of low and high (Tg) polymers present in the polymeric matrix. Low (Tg) polymers, in some embodiments, can enhance the adaptability of the complex 3D shape under compression pressure. High (Tg) polymers, in some embodiments, can help in retaining the shape of the impregnated nonwoven fiber web. The PET fibers achieve softening temperatures in the range of 70 to 80 degrees Celsius and rest of the shaping is aided by the applied pressure.

In another embodiment of the present disclosure, impregnated nonwoven fiber web can be further coated with a thermal coating composition comprising a carrier; acrylic copolymer; additives; fillers and colorants. The carrier comprises water in an amount of 30% by weight, based on the weight of the total thermal composition. Water can provide thermal resistivity to the overall composition. Acrylic copolymers can be selected from the group comprising vinyl acetate and ethylene in an amount of about 69% by weight. Additives can be selected from the group comprising emulsifiers and can be present in an amount of about 1% by weight. The emulsifier acts as a process aid in the formulation. Fillers can be selected from the group comprising silica bubbles (glass bubbles), mica and cenospheres and can be present in an amount of about 2% by weight. Glass bubbles in the formulation can provide thermal insulation properties. The colorant can be selected from the group comprising black dye, yellow dye, and blue dye and be present in an amount of about 1 to 3% by weight. All weight percentages recited in this paragraph are based on the total weight of the thermal coating composition.

Thermal coating compositions can be coated onto impregnated nonwoven fiber web by way of standard coating methods, which include brush coating, dip coating, and air spraying.

Nonwoven fiber web coated with thermal resisting composition can exhibit good bonding with a treated web, and can exhibit nonflammable behavior with high thermal resistivity. These materials can easily be used in any application that requires thermal resistivity including automobiles, aerospace, marine, locomotives, building acoustics including concrete slab insulation, appliances and other potential product application requiring acoustic and thermal properties.

Figure 7:
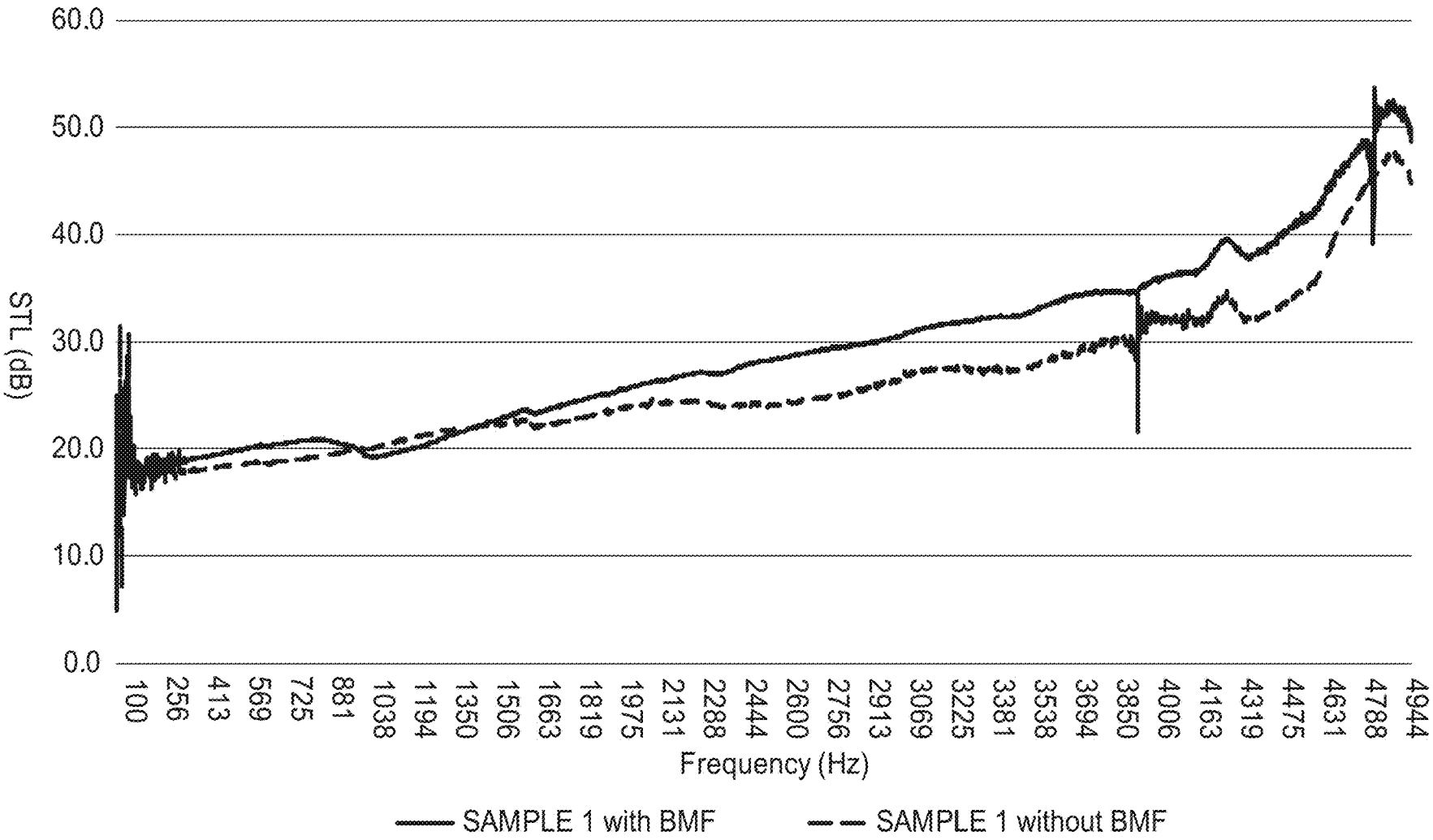
FIG. 7 is a graph showing the enhanced STL of an embodiment of an impregnated nonwoven fiber web of the present invention coupled with a blown melt fiber (BMF) with the same embodiment that does not contain a BMF web.

In another embodiment of the present disclosure, the noise control article, when coupled with a nonwoven acoustic material like lofty low density blown melt fiber (BMF), shows enhanced sound transmission loss in range of 1500-4500 Hz. Nonwoven acoustic materials can be selected with basis weights in the range of from 200 to 700 gsm. In an embodiment of the present disclosure, the noise control article can be used as an additional material to available nonwoven acoustic materials and provide additional protection from thermal exposures without losing its STL property. FIG. 7 shows the enhanced STL performance when the noise control article is coupled with BMF. Sample 1, i.e., noise control article when coupled BMF shows enhanced STL performance as compared to the same noise control article without using a BMF.

EXEMPLARY EMBODIMENTS

Embodiment A is a conformable noise control article for a motor vehicle comprising a nonwoven fiber web with a density between 100 to 1200 gsm that is impregnated with a polymeric matrix composition. The polymer matrix composition comprises:

15-25% by weight, relative to the overall weight of the polymeric matrix composition, of a low glass transition temperature (Tg) polymer;

10-50% by weight, relative to the overall weight of the polymeric matrix composition, of a high glass transition temperature (Tg) polymer; and one or more additives and inorganic fillers;

wherein the density of the noise control article is at least ten times more than the density of the nonwoven fiber web, the noise article has an air flow resistivity at least ninety times greater than the air flow resistivity of the nonwoven fiber web, and the noise article exhibits a Sound Transmission Loss (STL) in the frequency spectrum of 125 Hz to 5000 Hz.

Embodiment B is the noise article of Embodiment A, wherein the low (Tg) polymer has a (Tg) of −10 to 50 degrees Celsius.

Embodiment C is the noise article of Embodiment A, wherein the high (Tg) polymer has a (Tg) 10 to 135 degrees Celsius.

Embodiment D is the noise article of Embodiment A, wherein the nonwoven fiber web is a polyethyleneterephalate fiber web, the low (Tg) polymer is an aqueous copolymer dispersion of acrylic acid ester and styrene, the high (Tg) polymer is an aqueous copolymer of ethyl acrylate and methyl methacrylate.

Embodiment E is the noise article of Embodiment D, wherein the noise article maintains its sound transmission loss in the frequency spectrum of 125 Hz to 5000 Hz after exposure to a 120 degree Celsius for 1000 hours.

Embodiment F is the noise article of Embodiment of A, wherein the noise article reduces noise generated inside a motor vehicle through resonant vibration and reduces the transmission of noise of frequencies between 125 and 160 Hz into the cabin from incident noise sources.

Embodiment G is the noise article of Embodiment of A, having a basis weight between 1000 to 7700 gsm.

Embodiment H is the noise article of Embodiment A, wherein the noise article further exhibits 39% or greater sound transmission class for a 119% basis weight increase from the base bare mild steel panel.

Embodiment I is the noise article of Embodiment A, further comprising a layer of non-woven blown micro fiber web of 200 to 700 grams per square meters.

Embodiment J is the noise article of Embodiment I, wherein the noise article exhibits higher sound transmission loss between 1500 and 4500 Hz than an article that does not comprise a blown micro fiber web.

Embodiment K is the noise article of Embodiment A, wherein the nonwoven fiber web is polyester felt web.

Embodiment L is the noise article of Embodiment A, wherein the low (Tg) and high (Tg) polymers are present in the polymeric matrix composition in a ratio of about 3:2.

Embodiment M is the noise article of Embodiment A, wherein the one or more additives are selected from the group consisting of wetting agents, dispersants and combination thereof.

Embodiment N is the noise article of Embodiment A, wherein the one or more additives are present in the range of 1.0 and 3.0% by weight of the polymeric matrix composition.

Embodiment O is the noise article of Embodiment A, wherein the one or more inorganic fillers are selected from the group consisting of mica, calcium carbonate, silica bubbles, cenospheres and combinations thereof.

Embodiment P is the noise article of Embodiment A, wherein the one or more inorganic filler is present in the range of 1.0 to 50% by weight of the polymeric matrix composition.

Embodiment Q is the noise article of Embodiment A, wherein the noise control article displays a drawability up to 310 mm without pre-heating.

Embodiments A to Q are noise control articles that exhibit flame resistance.

EXAMPLES

Example 1

Preparation of Polymeric Matrix Composition

A polymeric matrix composition for an embodiment of the present disclosure is detailed in Table 1. It was manufactured by dissolving and mixing the various ingredients into water at room temperature.

TABLE 1

| CONSTITUENTS | COMPOSITION (in wt %) | SUPPLIER | PRODUCT NAME |
|---|---|---|---|
| Water | 6.7% | NA | NA |
| copolymer of acrylic acid ester and styrene (low Tg) | 21.4% | BASF India Ltd. India | Acronal S400 |
| copolymer of ethyl acrylate and methyl methacrylate (high Tg) | 14.3% | Magnum Polymers, India | Savron 3107 |
| Polyethylene glycol (additive) | 1.5% | Vinayak Auxicam, India | PEG200 |
| Aerosol (wetting agent) | 1.0% | Vinayak Auxicam, India | Aerosol OT |
| Polyacrylic acid sodium salt (dispersing agent) | 1.0% | Vinayak Auxicam, India | Dispex 4143 |
| Calcium Carbonate (CaCO3) | 44.0% | 20 micron, India | 4010 |
| Cenosphere (filler) | 2.0% | Petra buildcare, India | Pillit 300S |
| Mica (filler) | 5.0% | Commercial grade, India | Mica |
| Glass bubble (filler) | 2.0% | 3M Company, India | K15 |
| Black pigment | 1.1% | Vinayak Auxicam, India | Black pigment |

Example 2

Impregnation of a Nonwoven Fiber Web with a Polymeric Matrix Composition to Yield an Impregnated Nonwoven Fiber A nonwoven fiber web (available from AIM Filtertech Pvt Ltd, India, generally called as mixed fiber web (MFW), was impregnated with the polymeric matrix according to Example 1. The nonwoven fiber web had a basis weight of 500 gsm and was 10 mm thick. The nonwoven fiber web was dipped onto a tank containing the polymeric matrix composition. Excess polymeric matrix composition was removed from the nonwoven fiber web by passing the nonwoven fiber web between two squeeze rollers. The pressure exerted onto the fiber by the rollers is adjusted to obtain a final nonwoven article. Polymeric matrix impregnated nonwoven fiber web was dried in a continuous oven consisting of 6 heating zones of 10 meters each. The set temperature of zone 1 and 2 was 120 degrees centigrade and the set temperature for zone 3, 4, 5 and 6 was 180 degrees centigrade. The web speed into the driers was 4 meters per second with the gap between the heating zone. The total distance travelled by the nonwoven fiber web was 120 meters (60 meters inside the woven and 60 meters outside the oven) and the impregnated nonwoven fiber web was dried for 2.5 minutes in each oven. The resulting impregnated nonwoven fiber web had a weight of 3000 gsm. Weight and thickness of the impregnated nonwoven fiber web may vary depending on the squeezing pressure between the rolls using the same composition as described in Table-1.

Example 3

Performance Characteristic of the Impregnated Nonwoven Fiber Web Against Normal Nonwoven Fiber Through Air Flow Resistivity Test Impregnated nonwoven fiber web was obtained by following the process explained in Example 2 using the polymeric matrix composition made according to Example 1. Impregnated nonwoven fiber web (3000 gsm) and a nonwoven fiber (500 gsm) without impregnation was selected for air flow resistivity test and the data is shown in Table 2. This test shows the tendency of the impregnated nonwoven fiber web to withstand the airflow as compared to normal nonwoven fiber. Table 2 shows the airflow resistivity of the impregnated nonwoven fiber web against the normal nonwoven fiber web without impregnation.

Test method: This test was done as per ASTM C-522 standard.

TABLE 2

| Air Flow Resistivity (AFR) rayl/m | |
|---|---|
| Impregnated nonwoven fiber web (3000 gsm) | 1148264 |
| Normal nonwoven fiber web (500 gsm) without impregnation) | 12369 |

FIG. 1 and Table 2 show the air flow resistivity of the impregnated nonwoven fiber web, which was increased up to 90 times as compared to normal nonwoven fiber web.

Example 4

Sound Transmission Loss Test (STL)

This test was performed to show sound transmission through the impregnated nonwoven fiber web against a normal nonwoven fiber web (not impregnated).

Test Method: This test was done as per ASTM E-2611 standard.

Figure 2:
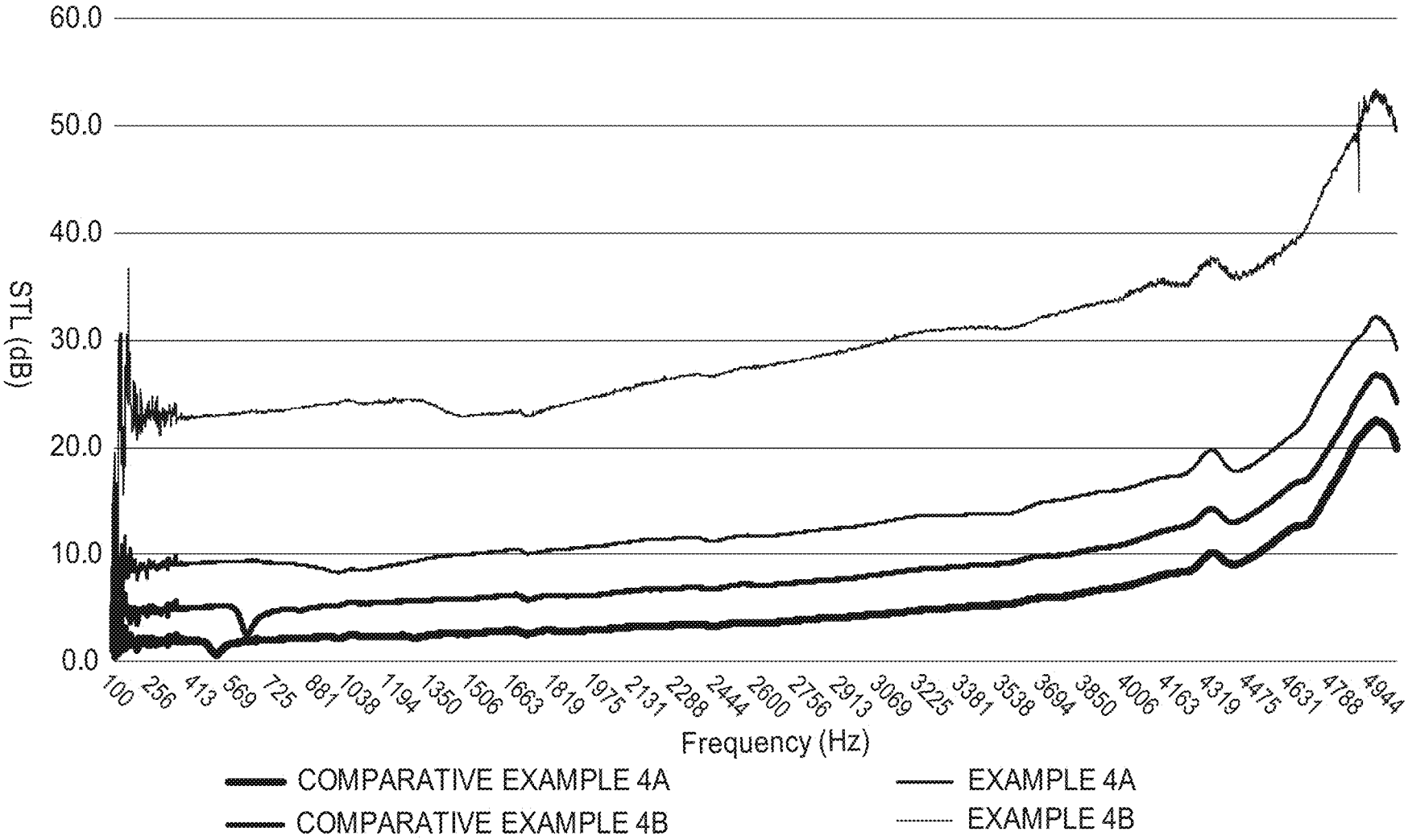
FIG. 2 is a graph showing the sound transmission loss (STL) of various embodiments of the invention and the non-woven fibrous web used to make the embodiments.

Samples of both impregnated nonwoven fiber web and normal nonwoven fiber web haivng different basis weights were selected for STL testing as shown in FIG. 2. Impregnated nonwoven fiber web Examples 4A and 4B had a basis weight of 2100 gsm and 5500 gsm respectively. These samples were prepared using the polymeric matrix composition made according to Example 1 using the process of Example 2. Comparative Examples 4A and 4B were normal (i.e., bare) nonwoven fiber web without impregnation having basis weights of 500 gsm and 1200 gsm respectively. As the data in FIG. 2 shows, the impregnated nonwoven fiber web of the present invention as embodied in Examples 4A and 4B showed higher sound transmission loss in the entire frequency range of 125 Hz to 5000 Hz.

Example 5

Sound Transmission Loss Test (STL)

This test was performed to show sound transmission loss through the noise control article as compared to other commercially available conventional materials.

Test Method: This test was done as per ASTM E-2611 standard.

Figure 3:
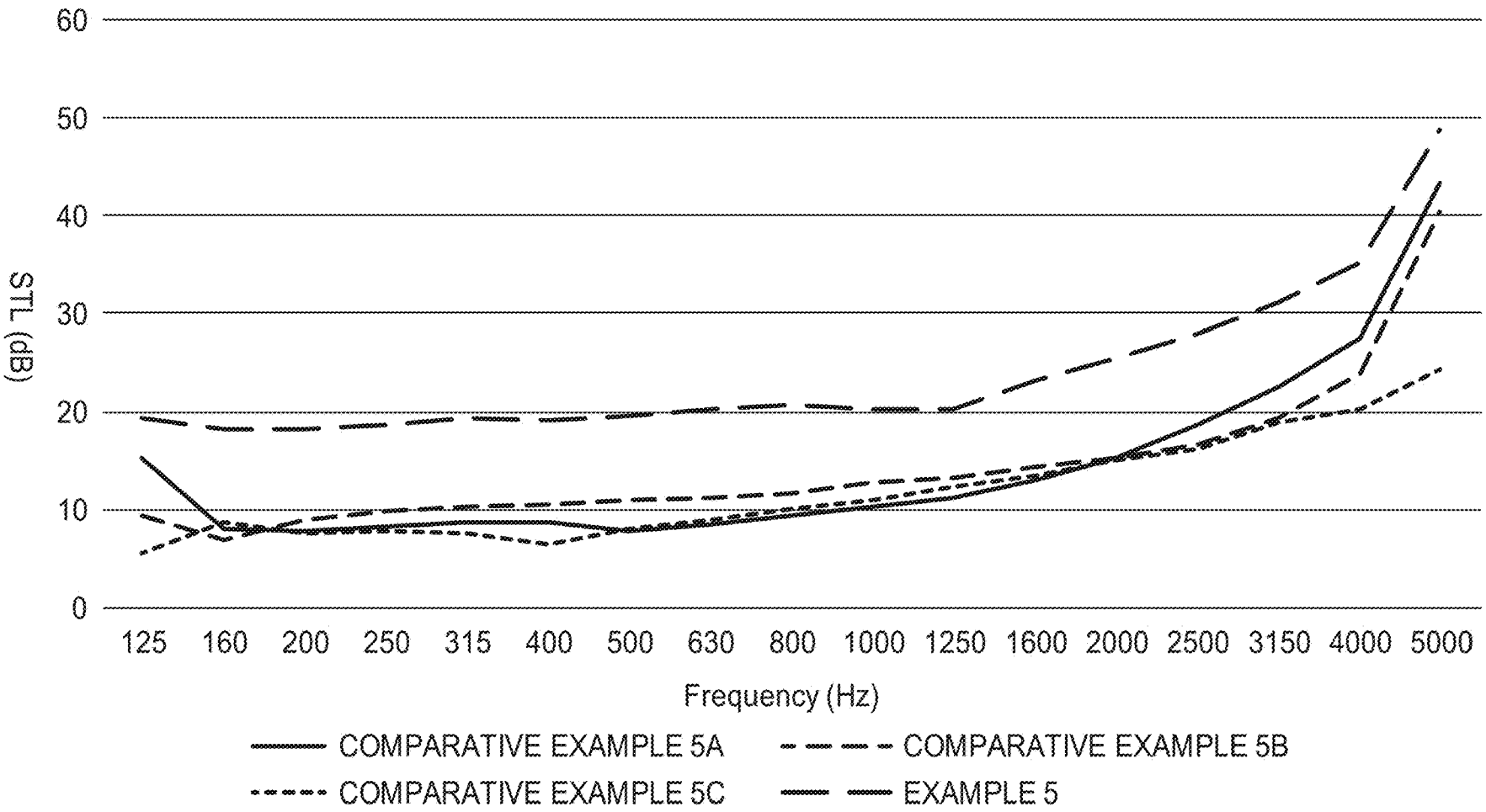
FIG. 3 is a graph showing the STL of various embodiments of the invention and several conventional noise absorber materials.

A sample of Example 5 had a basis weight of 4500 gsm and a thickness of 35 mm and was prepared according to Example 1 using the process explained in Example 2. As the data in FIG. 3 and Table 3 show, Example 5 of the present invention exhibited higher sound transmission loss across the entire frequency range of 125 Hz to 5000 Hz as compared to conventional noise treating materials of Comparative Examples 5A, 5B and 5C. Comparative Example 5A, a commercially available material had a basis weight of 5800 gms and a thickness of 32 mm. Comparative Example 5B, a commercially available material of polyurethane foam, had a basis weight of 6200 gsm and a thickness of 25 mm. Comparative Example 5C, a commercially available ethyl vinyl acetate rubber had a basis weight of 4800 gms and a thickness of 20 mm.

TABLE 3

| Construction Type | Avg STL (125 Hz~5000 Hz) in dB | Avg STL (125 Hz~1000 Hz) in dB | Avg STL (1000 Hz~2500 Hz) in dB |
|---|---|---|---|
| Comparative Example 5A | 26.34 | 8.79 | 14.36 |
| Comparative Example 5B | 23.51 | 10.84 | 14.75 |
| Comparative Example 5C | 17.42 | 8.82 | 14.05 |
| Example 5 | 33.91 | 19.82 | 24.14 |

The noise control article (Example 5) is light in weight as compared to other conventional samples as tested in the above table.

Example 6

Sound Transmission Loss (STL)—Noise Measurement Using Reverbration Chamber Method This test was performed to show sound transmission loss through the noise control article.

Test Method: This test was done as per ASTM E 90 standard.

Figure 4:
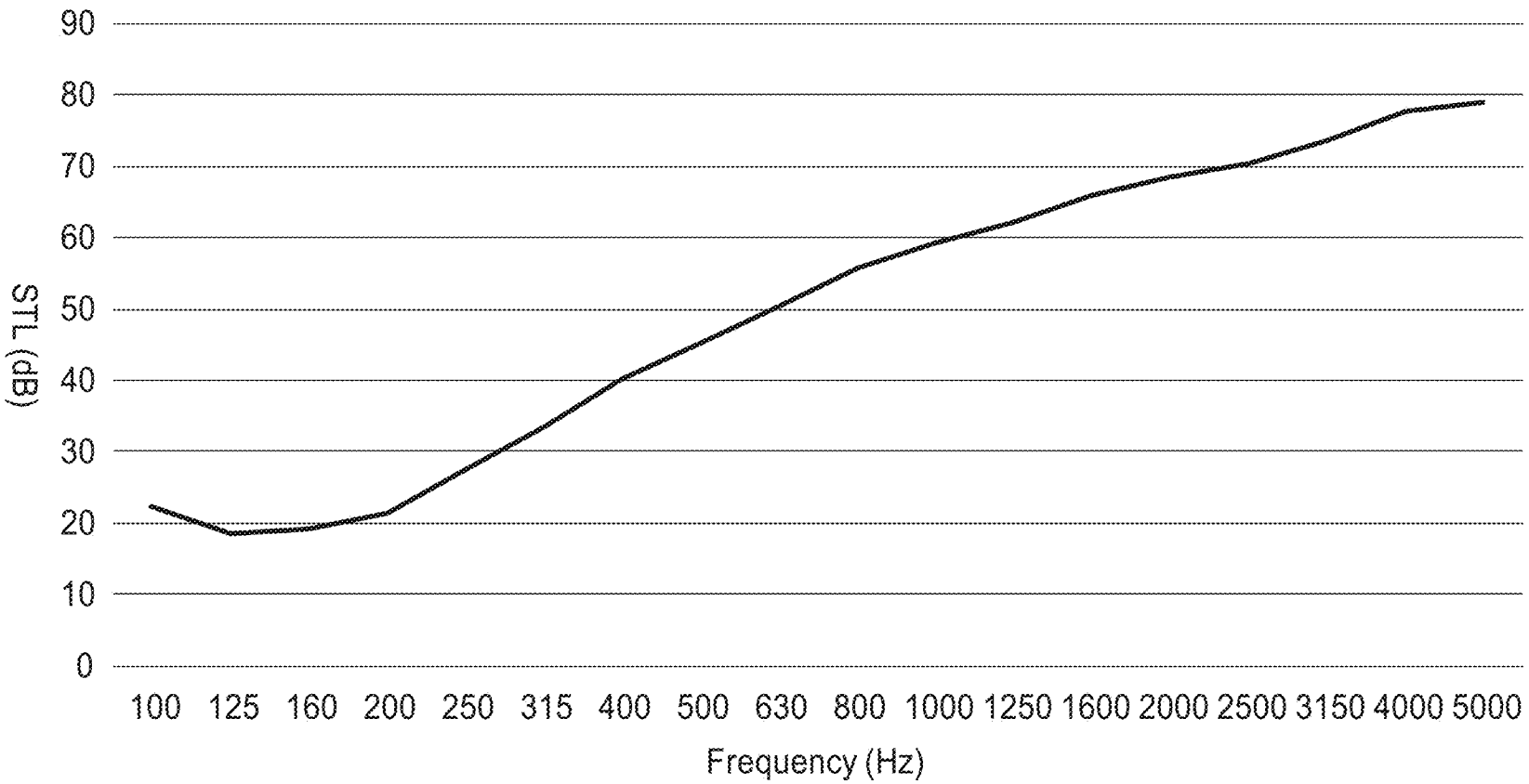
FIG. 4 is a graph showing the STL of an embodiment of the invention measured in a reverberation chamber.

A sample of Example 5 made above was subjected to STL test in a reverberation chamber and the results are shown in FIG. 4. This Example 5 exhibited higher sound transmission loss across the entire frequency range of from 125 Hz to 5000 Hz. Table 4 shows the STL with various frequency ranges starting from 100 Hz to 5000 Hz.

TABLE 4

| One third octave frequency, Hz | Sound Transmission Loss, dB |
|---|---|
| 100 | 22.5 |
| 125 | 18.7 |
| 160 | 19.3 |

TABLE 4-continued

| One third octave frequency, Hz | Sound Transmission Loss, dB |
|---|---|
| 200 | 21.4 |
| 250 | 27.4 |
| 315 | 33.6 |
| 400 | 40.3 |
| 500 | 45.4 |
| 630 | 50.3 |
| 800 | 55.8 |
| 1000 | 59.2 |
| 1250 | 62.1 |
| 1600 | 65.9 |
| 2000 | 68.3 |
| 2500 | 70.4 |
| 3150 | 73.4 |
| 4000 | 77.7 |
| 5000 | 78.9 |

Example 7

Sound Transmission Loss (STL)—Noise Measurements Using Reverbration Chamber Method This test was performed to show sound transmission loss through the noise control article.

Test Method: This test was done as per JIS 1441 standard.

Figure 5:
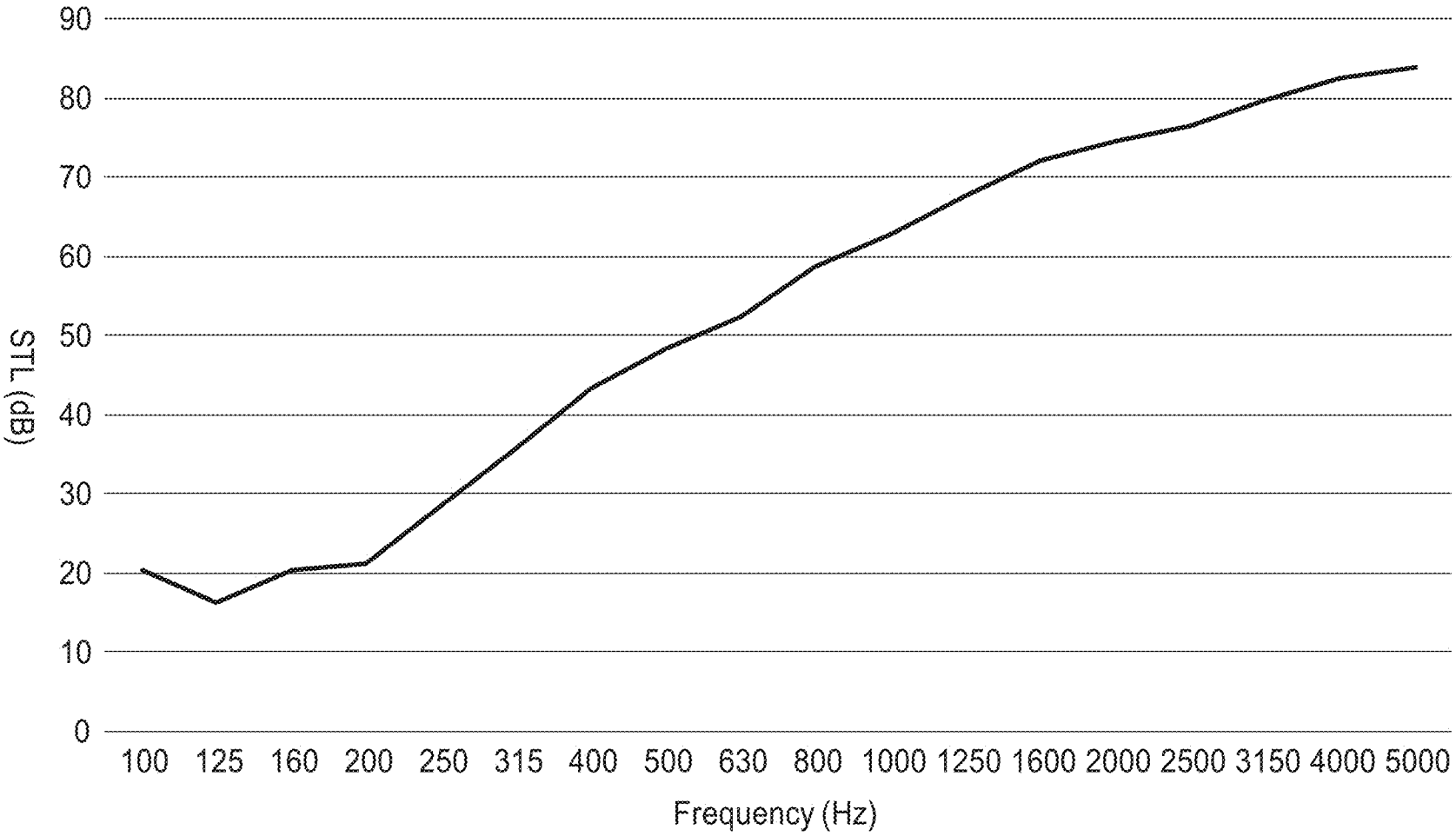
FIG. 5 is a graph showing the STL of another embodiment of the invention measured in a reverberation chamber.

A sample of Example 5 made above was subjected to SU test in a reverberation chamber and the results are shown in FIG. 5. This Example 5 exhibited higher sound transmission loss across the entire frequency range of 125 Hz to 5000 Hz. Table 5 shows the STL with various frequency ranges starting from 100 Hz to 5000 Hz.

TABLE 5

| One third octave frequency, Hz | Sound Transmission Loss, dB |
|---|---|
| 100 | 20.4 |
| 125 | 16.3 |
| 160 | 20.3 |
| 200 | 21.3 |
| 250 | 28.7 |
| 315 | 35.6 |
| 400 | 43.3 |
| 500 | 48.3 |
| 630 | 52.5 |
| 800 | 58.6 |
| 1000 | 62.8 |
| 1250 | 67.8 |
| 1600 | 72.1 |
| 2000 | 74.6 |
| 2500 | 76.6 |
| 3150 | 79.7 |
| 4000 | 82.6 |
| 5000 | 83.9 |

Example 8

Sound Transmission Loss (STL)—Tested After Heat Aging

This test was performed to show sound transmission loss through the noise control articles after exposure to heat at 120 degrees Celsius for 500 hours and 1000 hours.

Test Method: This test was done as per ASTM E-2611 standard.

Figure 6:
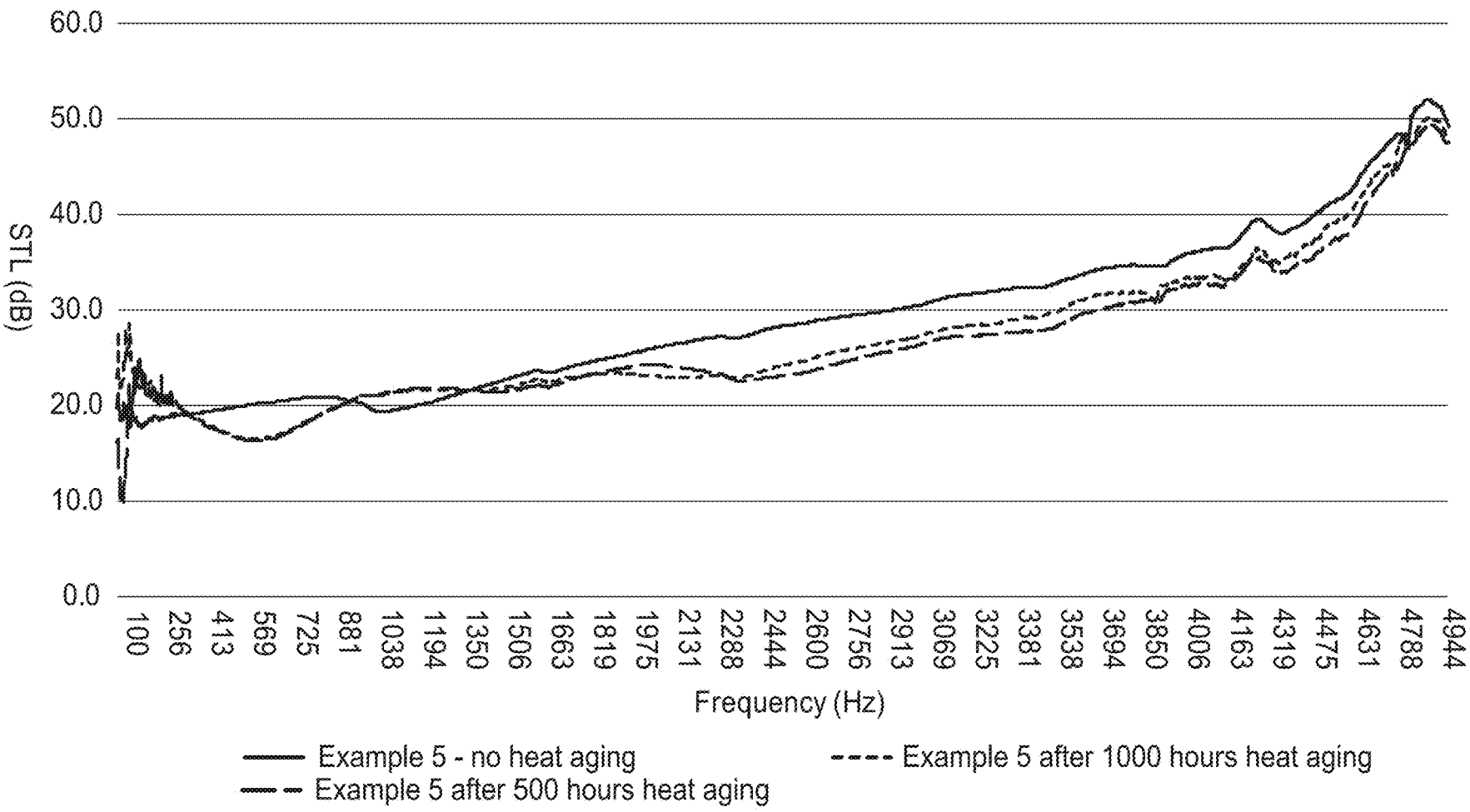
FIG. 6 is a graph showing the STL of an embodiment of the invention before and after heat ageing.

A sample of Example 5 made above was exposed to a temperature of 120 degree Celsius for a first period of 500 hours and then extended for a second period of another 500 hours for a total of 1000 hours. As the data shows in FIG. 6 and Table 6, the noise control article of Example 5 substantially retained its STL performance after heat aging.

TABLE 6

| Construction Type | Avg STL (125 Hz~5000 Hz) in dB | Avg STL (125 Hz~1000 Hz) in dB | Avg STL (1000 Hz~2500 Hz) in dB |
|---|---|---|---|
| Example 5 - no heat aging | 33.91 | 19.82 | 24.14 |
| Example 5 after 500 hours heat aging | 30.7 | 18.78 | 22.57 |
| Example 5 after 1000 hours of heat aging | 31.68 | 19.34 | 22.44 |

Example 9

Flammability Resistance Test

Example 5 was subjected to a flammability test as described below.

Flammability Test Method 1: This test was done as per FMVSS302 standard.

Test Procedure:

The test was conducted inside a flame chamber with a sample of Example 5 mounted horizontally. The exposed side of the sample was subjected to a gas flame from underneath. The burnt distance on the sample and the time taken to burn this distance was measured during the test. The result, characterized as a burning rate, was expressed in mm/min.

TABLE 7

| Sample | Observation | Burn Rate (mm/min) | Rating as per FMVSS 302 |
|---|---|---|---|
| Example 5 | Flame stops after 1st scribed line on the sample | <100 | PASS |

Flammability Test Method 2: This test was done as per UL94Vo standard.

Test procedure:

Five specimens of Example 5 were tested after conditioning for 48 hours at 23 degrees Celsius and 50% relative humidity (RH). Each specimen was mounted along its vertical axis. Each specimen was supported such that its lower end was 10 mm above Bunsen burner tube. A blue 20 mm high flame was applied to the center of the lower edge of the specimen for 10 seconds and removed. If burning ceased within 30 seconds, the flame is was reapplied for an additional 10 seconds. If the specimen dripped, particles were allowed to fall onto a layer of dry absorbent surgical cotton placed 300 mm below the specimen.

Test requirements per UL94Vo standard:

The specimens may not burn with flaming combustion for more than 10 seconds after either application of the test flame. The total flaming combustion time may not exceed 50 seconds for the 10 flame applications for each set of 5 specimens. The specimens may not burn with flaming or glowing combustion up to the holding clamp. The specimens may not drip flaming particles that ignite the dry absorbent surgical cotton located 300 mm below the test specimen. The specimens may not have glowing combustion that persists for more than 30 seconds after the second removal of the test flame.

TABLE 8

| | Burn time for after test flame application | Dripping flaming particles that ignite the cotton | Rating as per UL-Vo |
|---|---|---|---|
| Example 5 | <10 seconds/sample | No | Pass |

Example 10

Resonance Chart When Noise Control Article is Tested in Reverbration Chamber For STL Analysis

TABLE 9

| Sound Transmission Loss Performance (Reverberation Chamber Data) | | | | | | | | | | | | | | | | | | |
|---|---|---|---|---|---|---|---|---|---|---|---|---|---|---|---|---|---|---|
| | Region - I (Low Frequency) | | | | | | | | Region - II (Mid Frequency) | | | | | | Region - III (High Frequency) | | | |
| Total GSM | 100 | 125 | 160 | 200 | 250 | 315 | 400 | 500 | 630 | 800 | 1000 | 1250 | 1600 | 2000 | 2500 | 3150 | 4000 | 5000 |
| 3500 | 14.4 | 13.4 | 8.2 | 10.2 | 20.4 | 27.9 | 34.2 | 40.1 | 46.5 | 51.3 | 55.6 | 60.1 | 65.2 | 70.3 | 74.6 | 77 | 80.8 | 87 |
| 5500 | 17.1 | 14.1 | 9.6 | 14.5 | 25.3 | 32 | 38.2 | 44.4 | 50.5 | 55.3 | 60.2 | 63.8 | 68.4 | 73.6 | 77.5 | 78.8 | 82.9 | 89 |
| 6000 | 15.7 | 12.6 | 10.1 | 16.3 | 26.4 | 32.8 | 38.4 | 44.1 | 50.2 | 54.6 | 57.9 | 60.3 | 63.1 | 66.1 | 68.8 | 70.5 | 72.2 | 76.4 |
| 6700 | 16.4 | 12.2 | 8.7 | 17 | 25.9 | 33.8 | 38.4 | 43.9 | 51.8 | 56.1 | 60.9 | 64.2 | 68.9 | 73.4 | 77.8 | 78.5 | 81.8 | 88.1 |
| 7500 | 13 | 10.5 | 10.7 | 18.9 | 27.8 | 33.8 | 39.9 | 45.3 | 52.5 | 54.8 | 60.9 | 63.2 | 67.6 | 72.9 | 76.1 | 78.5 | 81.6 | 85.5 |

Table 9 shows that highest resonance point observed i.e. at 160 Hz across various low, middle and high GSM/Hz when noise control article is tested in reverberation chamber for STL analysis. The span of resonance observed across low, middle & high GSM/Hz was narrow (125 Hz-200 Hz) providing scope for building higher STL beyond resonance frequencies. Maximum growth trend in the STL values were observed in stiffness control regions (100 Hz-500 Hz) when compared to mass controlled region while doubling the mass of the noise control treating article.

Example 11

Preparation of Thermal Resistivity Formulation

The various components listed in Table 10 was dissolved and mixed into water at room temperature to yield a thermal resistivity formulation.

TABLE 10

| CONSTITUENTS | COMPOSITION (% by wt) | Supplier | Product |
|---|---|---|---|
| Water | 30 | N/A | N/A |
| Vinyl acetate/ethylene | 66 | Magnum Polymers, India | Savron FR |
| Emulsifier | 1 | Magnum polymers, India | Colonial AOS-40 |
| Glass Bubble | 2 | 3M Company | K15 |
| Black dye | 1 | Magnum Polymers | Black pigment |

Example 12

Thermal Conductivity Test

This test was done to demonstrate the thermal conductivity of the impregnated nonwoven fiber web/noise control article coated with thermal resistivity formulation as shown in table 11.

Test Method: This test was done as per ASTM C518 standard (Average temp: 22.5 degrees Celsius).

TABLE 11

| Setpoint | Mean Temperature deg C. | Delta Temperature deg C. | Thermal Conductivity W/mK | Thermal Resistance m^2*K/W | Temperature Gradient K/m | Test Time (hours) |
|---|---|---|---|---|---|---|
| 1 | 22.28 | 19.98 | 0.048153 | 0.291823 | 1422.17 | 01:35:54 |

Example 13

Odour Test

A sample of Example 5 was subjected to an odour test as described below.

Test Method: This test was done as per SAE J1351 standard.

TABLE 12

| | Avg. Rating | | |
|---|---|---|---|
| | Dry | Wet | Result |
| impregnated nonwoven fiber web/noise control article | 2 | 2 | No offensive odor |

Table 12 shows that the impregnated nonwoven fiber web/noise control article does not exhibit any objectionable odor.

Example—14

TABLE 13

| Total GSM | 125 | 160 | 200 | 250 | 315 | 400 | 500 | 630 | 800 | 1000 | 1250 | 1600 |
|---|---|---|---|---|---|---|---|---|---|---|---|---|
| Bare Mild Steel (MS) panel | 18 | 17 | 17 | 18 | 22 | 23 | 24.3 | 25 | 27 | 28.1 | 30.2 | 32.4 |
| 3500 | 21.4 | 15 | 17 | 25 | 28 | 33 | 38 | 43 | 48 | 52.4 | 56.2 | 60.5 |
| 5500 | 22.1 | 16 | 18 | 27 | 29 | 35 | 39.7 | 44 | 49 | 53 | 56.2 | 60.6 |
| 7500 | 21 | 18 | 22 | 28 | 30 | 36 | 40.4 | 45 | 49 | 53.2 | 56.8 | 60.8 |

| Total GSM | 2000 | 2500 | 3150 | 4000 | STC | % Basis Weight (g/m2) increase from Bare Mild Steel (MS) panel | % STC increase from Bare Mild Steel (MS) panel |
|---|---|---|---|---|---|---|---|
| Bare Mild Steel (MS) panel | 32.9 | 35.8 | 37 | 39.2 | 28 | 6280 (Reference) | 28 (Reference) |
| 3500 | 63.1 | 67 | 70.6 | 71.8 | 35 | 55% | 25% |
| 5500 | 62.9 | 66.7 | 70.6 | 72.7 | 36 | 87% | 28% |
| 7500 | 63.3 | 67.1 | 70.6 | 72.9 | 39 | 119% | 39% |

Table 13 shows the bare mild steel panel which was used as substrate on which the noise control article was applied, was also tested standalone for sound transmission loss from 125 Hz to 5000 Hz. Table 13 shows the sound transmission loss results of the bare mild steel (MS) panel and other basis weight noise control materials of the present invention. The noise control article exhibits up to 39% of sound transmission class for a 119% basis weight increase from the base bare mild steel panel.

What is claimed is:

1. A conformable noise control article for a motor vehicle comprising:

a nonwoven fiber web with a density between 100 to 1,200 gsm that is impregnated with a polymeric matrix composition, said polymeric matrix composition comprising:

15-25% by weight, relative to the overall weight of the polymeric matrix composition, of a low glass transition temperature (Tg) polymer, wherein the low glass transition temperature (Tg) polymer is an aqueous copolymer of acrylic acid ester and styrene possessing a glass transition temperature (Tg) in the range of −10 to 50 degrees Celsius;

10-50% by weight, relative to the overall weight of the polymeric matrix composition, of a high glass transition temperature (Tg) polymer, wherein the high glass transition temperature (Tg) polymer is an aqueous copolymer of ethyl acrylate and methyl methacrylate possessing a glass transition temperature (Tg) in the range of 10 to 135 degrees Celsius;

wherein the density of the noise control article is at least ten times more than the density of the nonwoven fiber web prior to impregnation with said polymeric matrix composition;

wherein the noise control article has an air flow resistivity at least ninety times greater than the air flow resistivity of the nonwoven fiber web prior to impregnation with said polymeric matrix composition, air flow resistivity being determined in accordance with ASTM C-522;

wherein the noise control article exhibits a sound transmission loss (STL) in the frequency spectrum of 125 to 5,000 Hz, as determined in accordance with ASTM E-2611.

2. The noise control article as claimed in claim 1, wherein the nonwoven fiber web is a polyethyleneterephalate fiber web.

3. The noise control article as claimed in claim 2 wherein the noise article maintains its sound transmission loss in the frequency spectrum of 125 Hz to 5,000 Hz after exposure to a 120 degree Celsius for 1,000 hours as determined in accordance with ASTM E-2611.

4. The use of a noise control article as claimed in claim 1, wherein the noise article reduces noise generated inside a motor vehicle through resonant vibration and reduces the transmission of noise of frequencies between 125 and 160 Hz into the cabin from incident noise sources as determined using a reverberation chamber method according to ASTM E 90 or JIS 1441.

5. The noise control article as claimed in claim 1 having a basis weight between 1,000 to 7,700 gsm.

6. The noise control article as claimed in claim 1, wherein the noise article further exhibits 39% or greater sound transmission class for a 119% basis weight increase from the base bare mild steel panel.

7. The noise control article as claimed in claim 1, further comprising a layer of non-woven blown micro fiber web of 200 to 700 grams per square meters.

8. The noise control article as claimed in claim 7, wherein the noise article exhibits higher sound transmission loss between 1,500 and 4,500 Hz than an article that does not comprise a blown micro fiber web sound transmission loss is determined in accordance with ASTM E-2611.

9. The noise control article as claimed in claim 1, wherein the nonwoven fiber web is polyester felt web.

10. The noise control article as claimed in claim 1, wherein the low (Tg) and high (Tg) polymers are present in the polymeric matrix composition in a ratio of about 3:2.

11. The noise control article as claimed in claim 1, further comprising one or more additives, wherein the one or more additives are selected from the group consisting of wetting agents, dispersants and combination thereof.

12. The noise control article as claimed in claim 1, further comprising one or more additives, wherein the one or more additives are present in the range of 1.0 and 3.0% by weight of the polymeric matrix composition.

13. The noise control article as claimed in claim 1, further comprising one or more inorganic fillers, wherein the one or more inorganic fillers are selected from the group consisting of mica, calcium carbonate, silica bubbles, cenospheres and combinations thereof.

14. The noise control article as claimed in claim 13, wherein the one or more inorganic fillers is present in the range of 1.0 to 50% by weight of the polymeric matrix composition.

15. The noise control article as claimed in claim 1, wherein the noise control article displays a drawability up to 310 mm without pre-heating.

16. The noise control article as claimed in claim 1, wherein the noise control article exhibits flame resistance.

* * * * *